United States Patent [19]

Schaefer, Jr.

[11] Patent Number: 4,513,957

[45] Date of Patent: Apr. 30, 1985

[54] ITEM DISPENSING SYSTEM

[75] Inventor: William J. Schaefer, Jr., Dayton, Ohio

[73] Assignee: NCR Corporation, Dayton, Ohio

[21] Appl. No.: 491,118

[22] Filed: May 3, 1983

[51] Int. Cl.[3] ..... B65H 3/08; B65H 7/14; B65H 7/16

[52] U.S. Cl. ..... 271/90; 271/91; 271/11; 271/108; 271/31.1; 221/211; 221/13

[58] Field of Search ..... 271/11, 12, 13, 20, 271/30 A, 90, 91, 93, 99, 100, 101, 102, 103, 271/104, 107, 108; 414/121; 221/211, 13, 21; 294/64 R

[56] References Cited

U.S. PATENT DOCUMENTS

| | | | |
|---|---|---|---|
| 3,617,048 | 11/1971 | Albert | 271/26 |
| 3,934,869 | 1/1976 | Strobel | 271/35 |
| 3,954,260 | 5/1976 | Morello et al. | 271/12 |
| 3,999,795 | 12/1976 | Barker | 294/64 R |
| 4,146,217 | 3/1979 | Barker | 271/108 |
| 4,200,277 | 4/1980 | Klenk et al. | 271/90 |
| 4,391,439 | 7/1983 | Edström | 271/108 |

*Primary Examiner*—Bruce H. Stoner, Jr.
*Assistant Examiner*—James E. Barlow
*Attorney, Agent, or Firm*—Albert L. Sessler, Jr.; George Jameson

[57] ABSTRACT

An item dispensing system is disclosed wherein in a preferred sheet dispensing embodiment, primary and secondary sets of vacuum cups are mounted to one end of a pick arm which is rotated between a stack of sheets and a dispensing path. Initially, a two-way valve is controlled to pass a vacuum from a vacuum source only to one of the primary and secondary sets of vacuum cups. The selected set of suction cups then attempts to vacuum lift and pass a sheet to and along the dispensing path. The failure of a sensor to sense that sheet in the dispensing path within a preselected period of time indicates that the selected set of vacuum cups may have been unsuccessful in vacuum lifting that sheet from the stack due to a poor vacuum seal between the selected set of vacuum cups and that sheet. Such a failure causes a processor to generate a signal to cause the two way valve to apply the vacuum from the vacuum source only to the other one of the primary and secondary sets of vacuum cups.

14 Claims, 2 Drawing Figures

ITEM DISPENSING SYSTEM

BACKGROUND OF THE INVENTION

The present invention relates to a dispensing system for providing an alternative means for feeding items, such as elements, sheets of paper or the like, from an item source to a dispensing path when a primary means fails to feed an item from the item source to the dispensing path, and particularly to a dispensing system for automatically providing an alternative vacuum path to a sheet of paper, such as a document, a bill or currency, that is to be vacuum picked from a sheet source when a primary vacuum path fails to pick up the sheet because of a flaw in the sheet at a location at which the primary vacuum path contacts the sheet.

The normal system for picking sheets from a stack uses an oscillating tube with two arms attached. These arms contain suction cups connected through the tube to a vacuum pump. The tube is turned carrying the suction cups into contact with the front sheet of paper. This contact is made in the lower portion of the sheet near its outer edges. At the time of contact, a vacuum is applied to the suction cups, causing them to adhere to the front sheet of paper. The direction of rotation of the tube is then reversed, carrying the lower portion of the top sheet through an arc which places the edge of the sheet in the open portion of an interrupted circumference drive roller (a "D" shaped roller) of a transport mechanism. When the full circumference portion of the drive roller contacts its associated tension or pinch roller, the sheet of paper is then pulled off the stack and placed in the transport mechanism.

As a practical matter, a system for picking sheets from a stack is designed to handle not only a new paper, but also used paper sheets, such as currency, bills and documents, which have been handled and carried by the public. Used paper sheets sometimes contain flaws, such as corner folds and other deep creases and folds, as well as tears and holes. Occasionally, the presence of one or more of these flaws in a sheet will make it impossible for the vacuum cups to seal sufficiently against that sheet to establish a level of vacuum necessary to cause that sheet to separate from the stack. When this event occurs, the equipment ordinarily must be taken out of service.

The present invention relates to a sheet dispensing system and is specifically adapted to minimize the down time of the system due to flaws in used sheets of paper in the stack. Since such a failure of the system is caused by a flaw in the paper sheet at the primary locations at which the primary suction cups make contact with the sheet, secondary locations are chosen for two auxiliary suction cups to make contact with the sheet. These secondary locations are far enough away from the primary locations that a flaw causing a failure in the primary locations will not normally affect a vacuum in the secondary locations.

The background art known to applicant at the time of the filing of this application is as follows:

U.S. Pat. No. 3,617,048, Vacuum Paper Feeder, by D. J. Albert;

U.S. Pat. No. 3,954,260, Paper Money Dispensing Mechanism, by H. Morello et al;

U.S. Pat. No. 3,999,795, Vacuum Pad System, by L. B. Barker; and

U.S. Pat. No. 4,146,217, Sheet Feed Mechanism For Offset Printing Machines And The Like, by R. J. Barker.

SUMMARY OF THE INVENTION

In accordance with one embodiment of the invention, an element dispensing system comprises: a source of elements; a dispensing path; pick-up means, including first and second means, movable between the element source and the dispensing path with one of the first and second means being operable to feed at least one element from the element source to the dispensing path; means for generating a signal in response to the failure of the one of the first and second means to feed an element to the dispensing path; and means being responsive to the absence of the signal for enabling the other one of the first and second means to feed the element to the dispensing path.

In accordance with another embodiment of the invention a method for dispensing elements comprises the steps of: moving first and second means together between a source of elements and a dispensing path; initially enabling one of the first and second means to feed at least one element from the element source to the dispensing path; sensing whether or not an element is present in the dispensing path; generating a signal when the presence of a given element is not sensed in the dispensing path within a preselected period of time; and enabling the other one of the first and second means to feed that element to the dispensing path whenever a signal is generated.

In an illustrated embodiment of the invention, primary and secondary sets of vacuum cups are mounted to one end of a pick arm which is oscillated between a stack of sheets and a dispensing path. Initially, a two-way valve is controlled to pass a vacuum from a vacuum source to the primary set of vacuum cups. The primary suction cups then attempt to vacuum lift and pass a sheet to and along the dispensing path. The failure of a sensor to sense that sheet in the dispensing path within a preselected period of time indicates that the primary set of vacuum cups may have been unsuccessful in vacuum lifting that sheet from the stack due to a poor vacuum seal between the primary set of vacuum cups and that sheet. Such a failure causes a processor to generate a signal to cause the two-way valve to switch the vacuum being applied from the vacuum source from the primary set of vacuum cups to the secondary set of vacuum cups.

It is, therefore, an object of this invention to provide an improved, more reliable system, and method therefor, for automatically dispensing sheets of paper.

Another object of this invention is to reduce the down time of a sheet dispensing system.

Another object of this invention is to provide a sheet dispensing system, and method therefor, having a redundant vacuum pick mechanism.

Another object of this invention is to provide a paper dispensing system, and method therefor, which switches a vacuum applied from a vacuum pump from a primary vacuum path to a secondary vacuum path when the primary vacuum path fails to vacuum pick a paper sheet from a stack.

A further object of this invention is to provide an element dispensing system, and method therefor, which enables a second holding means to feed an element from an element source to a dispensing path when a first holding means fails to feed that element from the element source to the dispensing path.

BRIEF DESCRIPTION OF THE DRAWINGS

These and other objects, features and advantages of the invention, as well as the invention itself, will become more apparent to those skilled in the art in the light of the following detailed description taken in consideration with the accompanying drawing wherein.

DESCRIPTION OF THE PREFERRED EMBODIMENT

Figure 1:
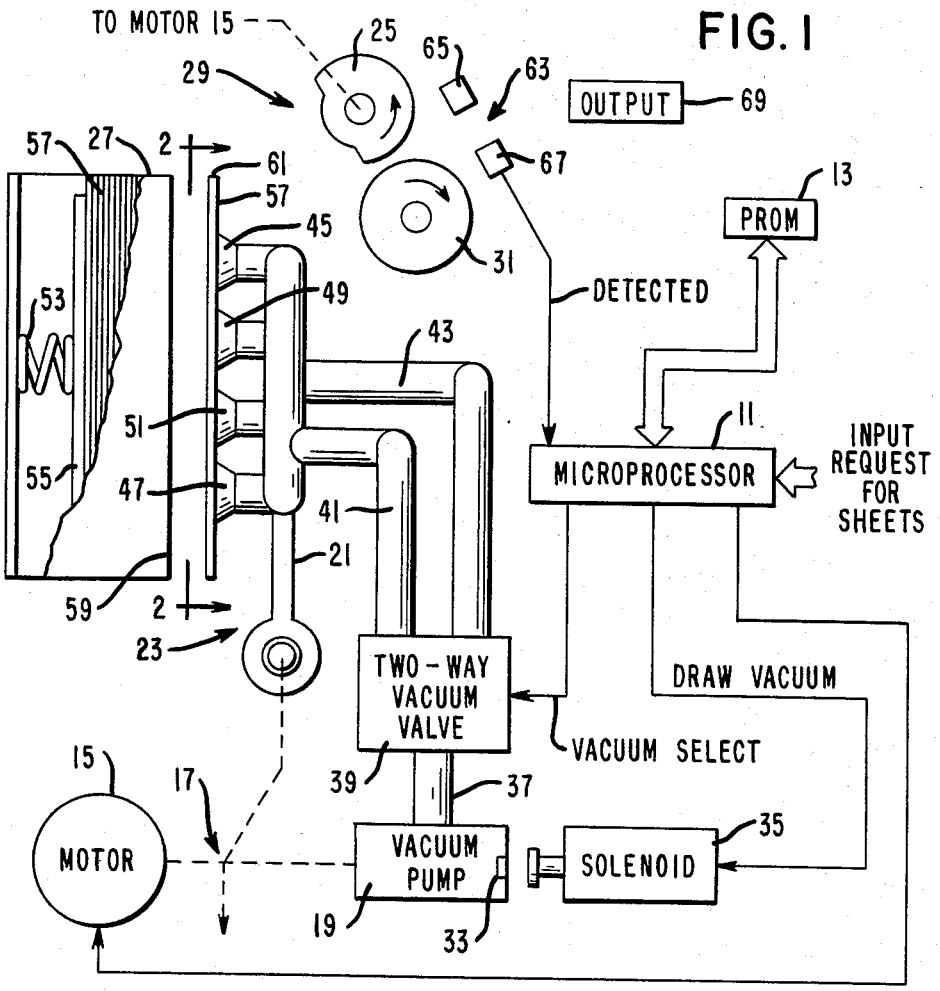
FIG. 1 is a schematic block diagram of a preferred embodiment of the invention.

Referring now to the drawings, FIG. 1 discloses a schematic block diagram of a preferred embodiment of the invention. Upon receiving an input request for one or more sheets of paper, which may be bills, notes, checks or any other types of sheets, a microprocessor 11 starts extracting and executing a software program from a programmable read only memory (PROM) 13. Structurally, microprocessor 11 can be an Intel 8085 AH microprocessor and PROM 13 can be an Intel 2716 EPROM. In the execution of the program from PROM 13, the microprocessor 11 basically performs the following operations.

Initially the microprocessor turns on a drive motor 15. The motor 15 is coupled through appropriate drive means 17, which may include an exemplary pulley and gear train assembly (not shown), to a vacuum pump 19, a pick-up arm 21 of a pick-up assembly 23 and a drive roller 25 to cause the vacuum pump 19, pick-arm 21 and drive roller 25 to operate or move in timed relationships with each other (to be explained). Such drive means 17 may include an eccentric (not shown) to drive the vacuum pump 19 and a cam (not shown) to drive the pick arm 21 to oscillate over an exemplary path of approximately 70 degrees between a sheet cassette 27 and a transport system 29 represented by the drive roller 25 and an associated tension or pitch roller 31.

The vacuum pump 19 may be a piston-type vacuum pump manufactured by the NCR Corporation, Dayton, Ohio and having NCR part number 277-009058. The eccentric drive to the vacuum pump 19 is operated continuously while the motor 15 is on. This continuous operation causes the piston (not shown) to move back and forth in the cylinder (not shown) of the pump 19. However, at this time the vacuum pump 19 draws no vacuum because it has a vent port 33 open to atmosphere.

After the motor 15 and drive means 17 have brought the vacuum pump 19, pick arm 21 and drive roller 25 up to their normal operational speeds, the microprocessor 11 sends a draw vacuum signal to a solenoid 35 to seal off the open vent port 33 of the pump 19. With port 33 closed, the next stroke of the vacuum pump 19 will enable the pump 19 to draw a vacuum. This vacuum from pump 19 is applied through line 37 to a two-way vacuum valve 39, which connects the line 37 to either a primary line 41 or a secondary line 43. The two-way vacuum valve 39 may be of the type made by Brunswick Technetics, a Division of Brunswick Corporation, having Part Number B3317-BB. Initially, the valve 39 is controlled by the microprocessor 11 (by the absence of vacuum select signal to the valve 39) to connect the line 37 to the primary line 41.

The pick-up assembly 23 includes an outer set of primary suction cups 45 and 47 and an inner set of secondary suction cups 49 and 51, all of which are mounted to one end of the pick arm 21 and are rotated therewith. For purposes of illustration, two sets of suction cups have been illustrated, with each set comprising two suction cups located as indicated above. However, it should be understood that additional sets could be provided for use with other multiple-way vacuum valves, and additional suction cups could be provided in each set to accommodate different widths or lengths of sheets of paper.

The cassette 27 is shown with a section broken away to show a spring 53 and follower plate 55 cooperating to force a stack of vertically positioned sheets 57 againt an exit 59 so that sheets 27 can be selectively picked by the suction cups 45 and 47 (or the suction cups 49 and 51).

In normal operation the vacuum from vacuum pump 19 is applied by way of line 37, valve 39 and line 41 to suction cups 45 and 47 as the pick-arm 21 rotates between the cassette 27 and transport system 29. As indicated before, the movement of the vacuum pump 19 is synchronized with the movement of the pick-arm 21. To accomplish this synchronization the movement of the piston in the vacuum pump 19 is so controlled by the movement of the eccentric drive that the vacuum pump 19 supplies a maximum vacuum when the pick-up arm 21 is rotated to the position of exit 59 to pick a sheet 57 from the cassette 27 and supplies a minimum vacuum when the pick-up arm 21 is rotated to the position of the transport system 29. Thus, this maximum vacuum from pump 19 will normally enable the suction cups 45 and 47 on the pick-arm 21 to pick a sheet 57 from the cassette 27 and feed that sheet 57 to the transport system 29.

The drive roller 25 in the transport system 29 is a D-shaped roller which has a deeply cut-away periphery. The rotation of the drive roller 25 is synchronized with the movement of the pick-arm 21 to assure that the outer edge 61 of a sheet 57 is passed between the cut-away periphery of drive roller 25 and its coacting tension roller 31 as the pick-arm 21 is rotated to the transport system 29. Further rotation of drive roller 25 allows the uncut portion of the drive roller 25 to contact the tension roller 31 and engage the sheet 57 therebetween, pulling the sheet 57 off of the suction cups 45 and 47. It will be recalled that the vacuum applied from the pump 19 is minimum at this time. Thus, the rollers 25 and 31 readily pull the sheet 57 off of the suction cups on the pick-arm 21 at this time.

Each sheet 57 that passes into and along the dispensing path between the rollers 25 and 31 then passes between a sensor 63 comprised of a light source 65 and a photodiode 67 before it is finally applied to an output 69. Output 69 may be a tray, a stacking wheel, another transport system or any other suitable means for utilizing sheets 57 being dispensed.

As a sheet 57 is moved between the light source 65 and photodiode 67, it interrupts the light path between the light source 65 and photodiode 67, causing the photodiode 67 to send a detected signal to the microprocessor 11 to indicate that a sheet 57 has been successfully picked and outputted to output 69.

The above operation is repeated for each sheet 57 that is requested by the input request for sheets that was applied to the microprocessor 11.

The sheet dispensing system of the invention is designed to handle not only new paper sheets, but also used paper sheets which have been previously handled or carried by the public. Used paper sheets sometimes contain flaws or defects, such as corner folds, other deep creases and folds, tears and perforations. Occasionally, the primary suction cups 45 and 47 will fall immediately against one or more of these defects in a sheet 57. When that happens, the vacuum applied to suction cups 45 and 47 attempts to rise to the level necessary to cause that sheet 57 to separate from the other sheets in the stack or cassette 27. However, the leakage around the defect in the sheet 57 may be so great that a sufficient vacuum is impossible.

When a flaw in a sheet 57 makes it impossible for the suction cups 45 and 47 to pick that sheet 57, the pick-arm 21 will continue to oscillate between the exit 59 of cassette 27 and the transport system 29, attempting to pick that defective sheet 57 on each oscillation. The software program in the PROM 13 will direct the microprocessor 11 to cause the pick assembly 23 to try to pick that sheet 57 for a predetermined number of times—for example, ten times. The system will go through the pick sequence of engaging the defective sheet 57, attempting to draw a vacuum and attempting to move the sheet 57 out from the cassette 27 and into the transport system 29. However, if after ten such attempts, the sensor 63 does not detect a sheet 57 in the transport system 29, the software program in PROM 13 will direct the microprocessor 11 to temporarily de-energize the solenoid 35 and turn off the motor 15 to stop the operations of the vacuum pump 33, pick-arm 21 and drive roller 25. The microprocessor 11 will then be directed to supply a vacuum select signal to the two-way vacuum valve 39 to cause the line 37 to be effectively coupled to secondary line 43 instead of primary line 41. The microprocessor 11 will then be directed to sequentially turn the motor 15 back on and energize the solenoid 35 to enable the vacuum pump to draw a vacuum.

Figure 2:
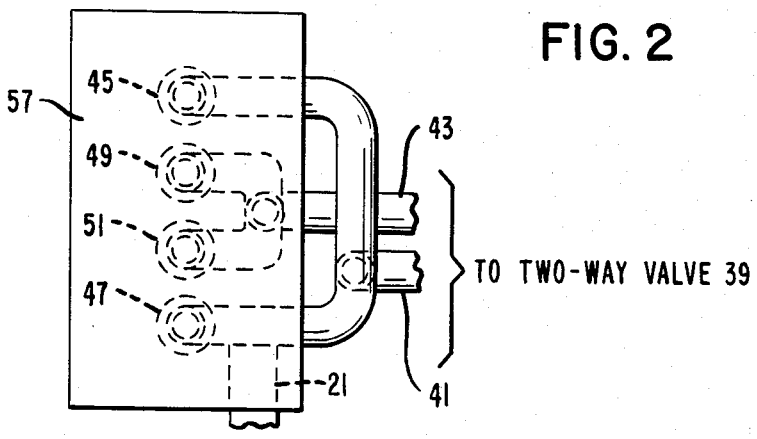
FIG. 2 is a cross-sectional view taken along the cut line 2—2 in FIG. 1.

The vacuum from vacuum pump 19 is now applied by way of line 37, valve 39 and line 43 to secondary suction cups 49 and 51 as the pick-arm 21 rotates between the cassette 27 and transport system 29. As shown in FIG. 2, the secondary suction cups 49 and 51 are so located that they contact areas of the sheet 57 different from those of the primary suction cups 45 and 47. These different secondary locations greatly enhance the chances of successfully picking the defective sheet 57.

At the end of this auxiliary or secondary cycle, the PROM 13 will sequentially direct the microprocessor 11 to de-energize solenoid 35, turn off motor 15, remove the vacuum select signal to restore the two-way valve 39 to its primary output along primary line 39, and then turn the motor 15 back on and energize the solenoid 35 with a draw vacuum signal, in order to restore the sheet dispensing system to its primary operation.

It should, however, be realized that, within the purview of the invention, the program in PROM 13 could be readily modified such that the PROM 13 would only direct the microprocessor 11 to cause the two-way vacuum valve 39 to switch from one of the output lines (41 and 43) to the other one of the output lines (43 and 41) when the suction cups (45, 47 or 49, 51) associated with the output line being utilized failed to pick a sheet 57.

The invention thus provides a dispensing system, and method therefor, for automatically providing an alternative means for feeding items from an item source to a dispensing path when a primary means fails to feed an item from the item source to the dispensing path.

While the salient features of the invention have been illustrated and described, it should be readily apparent to those skilled in the art that many other changes and modifications can be made in the system and method of the invention presented without departing from the spirit and true scope of the invention. Accordingly, the present invention should be considered as encompassing all such changes and modifications of the invention that fall within the broad scope of the invention as defined by the appended claims.

I claim:

1. A sheet dispensing system comprising:

a source of sheets;

a dispensing path;

pick-up means, including first and second means, movable between said sheet source and said dispensing path and being responsive to the application of a vacuum to one of said first and second means for feeding at least one sheet from said sheet source to said dispensing path;

means for generating a signal in response to the failure of said pick-up means to feed a sheet to said dispensing path when a vacuum is applied to said one of said first and second means; and means being responsive to the signal for applying a vacuum to the other one of said first and second means.

2. The system of claim 1 wherein said pick-up means further includes:

a pick-up arm, said first and second means being attached to that portion of said arm that is movable between said sheet source and said dispensing path.

3. The system of claim 2 wherein:

said first means comprises at least a first suction cup; and said second means comprises at least a second suction cup.

4. The system of claim 2 wherein:

said first means comprises a first set of suction cups; and said second means comprises a second set of suction cups.

5. The system of claim 4 wherein:

said first set comprises an inner pair of suction cups; and said second set comprises an outer pair of suction cups respectively positioned on opposite sides from said inner pair of suction cups.

6. The system of claim 4 wherein:

said first set comprises a pair of suction cups being engageable with a sheet at first and second positions of the sheet; and said second set comprises a pair of suction cups being engageable with a sheet at third and fourth positions of the sheet.

7. The system of claim 2 wherein said applying means includes:

a source of vacuum; and means, coupled between said supplying means and said first and second means, being responsive to the signal for changing the application of a vacuum from said vacuum source from one of said first and second means to the other one of said first and second means.

8. The system of claim 7 wherein said generating means includes:

sensing means positioned adjacent to said dispensing path for outputting a second signal each time that said pick-up means feeds a sheet to said dispensing path; and means for developing the signal in response to the failure of said sensor to develop the second signal for a given sheet.

9. The system of claim 8 wherein said developing means includes:

means for storing a program; and processor means controlled by said program storing means for producing the signal each time that said sensing means fails to output a second signal within a preselected period of time for a given sheet.

10. The system of claim 9 further including:

means operatively coupled to said pick-up arm and said vacuum source for operating said vacuum source in timed relationship with the movement of said pick-up means to supply a maximum vacuum when said pick-up means is positioned at said sheet source and a minimum vacuum when said pick-up means is positioned at said dispensing path.

11. The system of claim 7 further including:

means operatively coupled to said pick-up arm and said vacuum source for operating said vacuum source in timed relationship with the movement of said pick-up means to supply a maximum vacuum when said pick-up means is positioned at said sheet source and a minimum vacuum when said pick-up means is positioned at said dispensing path.

12. The system of claim 11 further including:

at least one pair of feed rollers in the dispensing path to sequentially receive sheets from said pick-up means.

13. A method for dispensing sheets, said method comprising the steps of:

moving first and second suction means together between a sheet source and a dispensing path;

producing a vacuum;

applying the vacuum to one of the moving first and second suction means to attempt to vacuum lift a sheet from the sheet source and pass it to the dispensing path;

sensing whether or not a sheet is present in the dispensing path;

generating a signal when the presence of a given sheet is not sensed in the dispensing path within a preselected period of time; and switching the application of the vacuum first the one of the first and second suction means to the other one of the first and second suction means whenever a signal is generated.

14. The method of claim 13 wherein said producing step includes the step of:

synchronously controlling the production of the vacuum as a function of the position of the first and second suction means in order to supply a maximum vacuum when the first and second suction means are positioned at the sheet source and a minimum vacuum when the first and second suction means are positioned at the dispensing path.

* * * * *